US005370708A

United States Patent [19]

Olson et al.

[11] Patent Number: 5,370,708

[45] Date of Patent: Dec. 6, 1994

[54] DECOLORIZING DYED FABRIC OR GARMENTS

[75] Inventors: Lynne A. Olson, Eagan; Elizabeth J. Gladfelter, Falcon Heights; Wendell D. Burch, Elko, all of Minn.

[73] Assignee: Ecolab Inc., St. Paul, Minn.

[21] Appl. No.: 136,386

[22] Filed: Oct. 13, 1993

Related U.S. Application Data

[62] Division of Ser. No. 571,740, Aug. 23, 1990, Pat. No. 5,268,002, which is a division of Ser. No. 321,969, Mar. 10, 1989, Pat. No. 4,997,450.

[51] Int. Cl.[5] ..... D06L 3/08

[52] U.S. Cl. ..... 8/108.1; 8/102; 8/107

[58] Field of Search ..... 8/102, 107, 108.1

[56] References Cited

U.S. PATENT DOCUMENTS

| | | | |
|---|---|---|---|
| 3,329,615 | 7/1967 | Cooper et al. | 252/99 |
| 3,769,224 | 10/1973 | Inamorato | 252/999 |
| 3,873,685 | 3/1975 | Kibbel, Jr. et al. | 424/16 |
| 4,024,257 | 5/1977 | Kibbel, Jr. | 424/249 |
| 4,218,220 | 8/1980 | Kappler et al. | 8/102 |
| 4,252,664 | 2/1981 | Inamorato | 252/99 |
| 4,517,166 | 5/1985 | Busacca | 423/474 |
| 4,570,229 | 2/1986 | Breen et al. | 364/476 |
| 4,692,335 | 9/1987 | Iwanski | 424/149 |
| 4,729,845 | 3/1988 | Altenschoepfer et al. | 252/99 |
| 4,740,213 | 4/1988 | Ricci | 8/108.1 |
| 4,795,476 | 1/1989 | Bean et al. | 8/107 |
| 4,832,864 | 5/1989 | Olson | 252/174.12 |
| 4,900,323 | 2/1990 | Dickson et al. | 8/111 |
| 4,961,751 | 10/1990 | Eissele et al. | 8/111 |
| 4,988,363 | 1/1991 | Barnes | 8/111 |
| 4,997,450 | 3/1991 | Olson et al. | 8/109 |
| 5,114,426 | 5/1992 | Milora et al. | 8/102 |
| 5,166,512 | 1/1965 | Mizuno | 252/99 |
| 5,190,562 | 3/1993 | Dickson et al. | 8/107 |
| 5,215,543 | 6/1993 | Milora et al. | 8/102 |
| 5,268,002 | 12/1993 | Olson et al. | 8/107 |

FOREIGN PATENT DOCUMENTS

| | | |
|---|---|---|
| 0238779 | 9/1987 | European Pat. Off. . |
| 0252317 | 1/1988 | European Pat. Off. . |
| 0275432 | 7/1988 | European Pat. Off. . |
| 2136029 | 9/1984 | United Kingdom . |

OTHER PUBLICATIONS

Chem. ABstract, No. 105 (2): 1181ee (1986) (month unknown).

Calculations of Analytical Chemistry, Fifth Edition, 1954, L. F. Hamilton et al. (month unknown).

Research Notes, IFI Fabricare News, Nov. 1987.

Daily News Record, vol. 17, No. 55, Mar. 23, 1987.

*Primary Examiner*—Ellen M. McAvoy

*Attorney, Agent, or Firm*—Merchant, Gould, Smith, Edell, Welter & Schmidt

[57] ABSTRACT

A process for creating decolorized areas in dyed fabric, the process comprising the step of contacting wet dyed fabric with a pelletized decolorizing agent and optionally also including quenching the active decolorant present in the decolorizing pellet with a decolorant neutralizer.

17 Claims, No Drawings

DECOLORIZING DYED FABRIC OR GARMENTS

This is a division of patent application Ser. No. 07/571,740, filed Aug. 23, 1990, now U.S. Pat. No. 5,268,002, which is a divisional of patent application Ser. No. 07/321,969, filed Mar. 10, 1989, now U.S. Pat. No. 4,997,450.

FIELD OF INVENTION

The invention relates generally to processes for the treatment of dyed fabrics and dyed sewn garments and, more specifically, to decolorizing compositions used to obtain an aesthetically pleasing decolorized look or fashionably faded look in fabric or garments.

BACKGROUND OF THE INVENTION

The popularity of denim fabrics among consumers of all ages has been well documented by sales in a large number of countries throughout the world. A major proportion of the denim garments sold are treated to impart some aesthetic or fashionable character to the fabric or garment. Two principle means of imparting an aesthetically pleasing decolorized look or fashionably faded look to denim fabrics or garments are the processes of stonewashing or, alternatively, ice washing. Stonewashing is a physical process which creates a "used and abused" appearance in fabric through a physical washing in the presence of stones or rocks having an abrasive surface.

Alternatively, fabrics may also be decolorized by ice washing. Generally, "ice washing" involves the use of a bleach such as sodium hypochlorite or potassium permanganate which is loaded onto an inert particle such as a porous rock or pumice stone. The potassium permanganate soaked stones are loaded into an industrial washing machine with the fabric. Once the machine is activated, the bleach-laden stones then contact the denim resulting in a discoloration of the exterior surface of the fabric.

A number of problems are presented by stonewashing and ice washing processes. First the use of pumice stones can generally create a considerable amount of damage to the goods as well as to the machinery used in the process. Specifically, the coarse or rough nature of the stones used in these prior art processes often result in wearing or destruction which is difficult to control. This wearing may result in unintended damage to the processing machinery necessitating repair or to the fabric making the garments unmarketable.

Moreover, the use of pumice stones creates problems in cleaning the fabric and the machinery once the processing has ended. Specifically, each denim garment must be manually "derocked" to remove the stones that have found their way into pockets, creases, and interior folds in the garment. This manual "derocking" of garments is completed at great expense which is ultimately reflected in the price the consumer must pay for the garment. Additionally, the industrial washing machines must be manually derocked by any number of workers who must literally shovel out the washing machines.

Furthermore, potassium permanganate, commonly used in ice washing processes, results in a manganese dioxide ($MnO_2$) chemical by-product after bleaching which has a brown sedimentary character. This sediment may be difficult to remove from the machines as well as from the fabric or garments. These inherent limitations in the prior art make these processes generally unsuitable for efficient large-scale production of decolorized denim. Given the limitations of the prior art there is substantial need for an improved process and composition for creating an aesthetic or fashionable decolorized look in denim fabric and garments.

BRIEF DISCUSSION OF THE INVENTION

The process of the present invention comprises producing an aesthetically pleasing or fashionably decolorized appearance by contacting fabric having a varying degree of wetness with a pelletized "rock-free" decolorizing agent. The pellet is typically formed from an active decolorant agent capable of chemically altering the dye in the fabric to a colorless state, and then quenching the active decolorant with a neutralizing agent once the decolorizing process is complete. The pellet is preferably free of inactive stone or rock carriers. By pelletized we mean the formation of the active decolorizing agent into a solid unit having a cylindrical, round, oval, etc., shape with a major dimension of about ⅛ of an inch or greater.

DETAILED DESCRIPTION OF THE INVENTION

Briefly, the process of the present invention comprises contacting dyed fabric with a pelletized decolorizing agent containing an active decolorant. The active decolorant may then be quenched with a chemical neutralizer. Optionally, the present invention may also comprise pretreatment steps including desizing of the dyed fabric. Furthermore, the process of the present invention may also include optional post-treatment steps which include the addition of brightening agents to the fabric and the washing and softening of the fabric towards the removal of all bleach and neutralizer compositions.

The Decolorizing Process

The process of the present invention can generally be defined in at least one step comprising contacting the dyed fabric with the pelletized decolorizing agent containing an active decolorant in the presence of water. Additionally, the process of the present invention may also comprise contacting the undissolved pelletized decolorizing agent with a neutralizer which quenches the active decolorant present in the system as well as dissolving any remaining pelletized decolorizing agent. Optionally, the process of the present invention may also include pretreatment and post treatment steps including desizing or swelling the dyed material prior to decolorizing, adding fabric softeners prior to or subsequent to decolorizing, adding active decolorant regulators to the dyed fabric prior to decolorizing, or adding rinsing, washing, or whitening agents after decolorizing.

The process of the present invention uses primarily a chemical decolorizer. There is no need to use stone or rock carriers which must be removed after processing. Rather the pelletized decolorizing agent remaining after processing is solubilized and extinguished (chemically neutralized or reduced) by either a decolorant neutralizer or aqueous rinsing or a combination of the both.

In order to initiate the process the ambient environment must provide an aqueous reaction medium which allows the active decolorant to contact and penetrate the dyed fabric. Generally, the aqueous medium may be provided in varying degrees ranging from slightly wetting to completely saturating the dyed fabric. The fabric may be wet through any means including prewetting prior to decolorizing or wetting during decolorizing. The simultaneous introduction of water and the decolorizing agent may be used to provide uneven decolorizing due to uneven wetting of the fabric and non-uniform activation of the decolorizing agent. Generally, a uniform wetting of the fabric may be provided prior to the initiation of the decolorizing process, by contacting the dyed or pigmented fabric with the intended concentration of water.

The water is then extracted from the dyed material. The extraction may be completed through any number of means including dry spinning within the same machine in which the material will eventually be decolorized. The amount of water extracted or removed from the dyed fabric, here again, has a significant impact on the resulting appearance imparted to the fabric material by the active decolorant. For instance, removal of a higher concentration of water from the material by a higher rate extraction or an extended extraction period reduces the fluid medium in which the active decolorant contained with the pelletized decolorizing agent may dissolve and penetrate the dyed material. Extracting a higher concentration of water from the dyed material reduces the water available to allow penetration of the active decolorant into the fabric completion. As a result, decolorizing in this environment may provide a fabric which is only slightly decolorized.

In contrast, the use of either a lower extraction rate or a shortened extraction period will result in the retention of a greater amount of water in the dyed material. In turn, a higher concentration of water allows increased dissolution and further migration of the active decolorant into the dyed material or fabric resulting in a heightened decolorized physical appearance across the exterior surface of the fabric. In fact, the retention of a high concentration of water within the dyed fabric can result in a physical appearance which resembles mottled tie-dyeing look. This relationship between water concentration and active is only limited by the eventual dilution of the active decolorant to a strength which will not effectively bleach the fabric in the intended time period. In short, the dyed fabric may retain a varying degree of wetness, and as the amount of retained water is increased in the dyed fabric, the degree of active decolorant migration is increased.

Decolorizing of the fabric is then undertaken through the addition of the pelletized decolorizing agent. The fabric may be retained in the washing machine that was used to pre-process the fabric. Generally, the pelletized decolorizing agent will be added to the fabric at a rate ranging from about ⅛ pound to about 5 pounds of pelletized decolorizing agent, and more preferably at a rate of about 0.25 pounds to 3.5 pounds of pelletized decolorizing agent per pound of goods. Most preferably, for reasons of economy, and ease of handling, the pelletized decolorizing agent is added at a level of about ½ pound to 2 pounds of decolorizing agent per pound of goods (fabric or garment).

Along with the composition of the pelletized decolorizing agent added to the fabric, there are other variables which may be altered to vary the decolorizing of the material. Specifically, the chemical formulation of the pellet can be altered. Moreover, the exposure time of the pelletized decolorizing agent to the material may also be varied to impart a wide range of effects. Generally, the time of the decolorizing step will range from about 10 minutes to 90 minutes and more preferably from about 15 minutes to 45 minutes.

Most preferably, the exposure time of the pelletized decolorizing agent to the material is about 30 minutes. However, here again, this time may vary depending on the physical decoloration to be imparted to the material, the nature of the fabric and dye. For instance, depending upon the ratio of decolorizing agent to material, extending the exposure time beyond 30 minutes may result in a higher level of fabric decolorizing. In contrast, lowering this exposure time may result in a lower degree of fabric decolorizing. As can be seen, the composition and process of the present invention provide a broad range of parameters which can be adjusted and attenuated to provide any number of physical appearances to the material.

An additional parameter which may affect the ability of the pelletized decolorizing agent to impart a decolorized effect to the material is the total load volume placed in the washing machine. The total volume of fabric and pelletized decolorizing agent may range in weight from 1% to 100% of the 25 lbs. to 900 lbs. effective weight capacity of the machine. However, the total load weight is preferably between about 10% and 60% of the total rated weight load of the machine, and more preferably between 20% and 50% of the total rated load weight of the machine. Presently, an optimal operating range has been a total load of material and pelletized decolorizing agent of about 30% of the total rated load weight of the machine.

Once the decolorizing process has been completed, the the active decolorant may be extinguished through a variety of means. Specifically, the pelletized decolorizing agent may be formulated to vary the type and concentration of constituents in the composition to result in any number of effects. For example, as will be seen in the following description of the pelletized decolorizing composition, the amount of active decolorant may be varied to provide a decolorizing composition which is self-quenching. The pelletized composition may include only the amount of active decolorant needed to create the desired decolorizing affect. The termination of the active decolorizing process will then coincide with the exhaustion of the active decolorant in the system. Additionally, binder and filler constituent concentrations may also be varied to provide a readily soluble pelletized decolorizing agent which completely dissolves during the decolorizing process. The pelletized decolorizing composition, formulated accordingly, requires no chemical agents to quench or neutralize the active decolorant.

Optionally, the active decolorant may be quenched through the addition of a decolorant neutralizer. Quenching may be undertaken through any variety of procedures. Generally, a decolorant neutralizer will be added prior to, or simultaneously with, water. The sequence of adding the decolorant neutralizer and the water provides for an even distribution of the neutralizer among the fabric. Here again, even distribution of the neutralizer will generally provide uniform fabric decolorizing which might not otherwise occur if the active decolorant was overly neutralized in certain areas of the fabric and unneutralized in other areas.

Preferably, the active decolorant neutralizer is added to the material while the machine is filling with water. The most important variables in the quenching of the active decolorant are the time allowed for neutralization and the concentration of reducing agent used to actually quench the active decolorant. Generally, the time allowed to quench the active decolorant will range from about 1 minute to 15 minutes and more preferably 5 minutes to 10 minutes. Most preferably a time of about 10 minutes is used to neutralize the active decolorant. This amount of time provides an adequate period for the decolorant neutralizer to be dispersed among the material and to effectively interact with the active decolorant. However, here again, the chemical effect of the decolorant neutralizer can be optimized or minimized by extending or limiting, respectively, the exposure time of the decolorant neutralizer to the material which has been previously treated with an active decolorant.

Additionally, the amount of decolorant neutralizer introduced into the machine containing the material will also vary the effect of the active decolorant on the material. Generally, the amount of decolorant neutralizer will be that which is stoichiometrically necessary to chemically neutralize the active decolorant. Accordingly, the amount of decolorant neutralizer will depend upon the mole concentration of active decolorant loaded onto the material and remaining pellet volume. If the active decolorant is to be completely quenched or neutralized, generally, a 1:1 mole ratio of decolorant neutralizer is introduced into the system. Using a lower concentration of decolorant neutralizer will preclude the complete suspension of the decoloration process. The continued presence of active decolorant may extend the fabric decolorizing effect, or may assist in fabric deterioration. In contrast, the use of a higher neutralizer concentration may result in a residual neutralizer on the fabric and in the machine.

As previously noted, the process of the present invention may also include any number of pretreatment steps to additionally alter or vary the physical decolorizing effect imparted to the fabric. Specifically, desizing may be undertaken to remove starch and starch-based materials from the fabric through application of a desizing agent such as an enzymatic desizing agent or an acetic or phosphoric acid desizing agent. Along with increasing the softness of the fabric, desizing may also be used to increase the absorbency and as a result, the susceptibility of the fabric to the decolorizing process.

Along with desizing, the dyed fabric may also be pretreated with any number of other chemical elements to create a variety of effects during the subsequent decolorizing process including fabric softeners, fabric swelling caustic, pretreatment agents such as a 10 wt-% solution of NaOH (50 w/v), etc. Specifically, an active decolorant neutralizer may be preloaded onto the fabric to allow for a more uniform decolorization of the fabric. In this instance, the active decolorant neutralizer may be used to prevent the formation of "hot spots". Hot spots are areas of localized decolorization where the active decolorant has had an extreme effect on the pigment in the material penetrating to the interior surface.

The process of the present invention is also intended to comprise optional post-treatment steps which may be undertaken after the fabric is decolorized.

Once the active decolorant is quenched or neutralized, the decolorizing process is completed and the material may be subjected to post-treatment. Post-treatment steps include additional rinsing to remove any residual pigment or dye product, chemical constituents, or other materials which are left in the washing machine.

Additional post-treatment steps include the use of scouring agents to treat the fabric or garments. Scouring agents such as an alkali source, peroxide bleaches, and surfactants may be used to remove any yellowing or discoloration caused by the active decolorant. Usually the active ingredient in the scouring agent is a material such as a percarbonate which is rinsed through the material for a time period ranging from about 5 to 20 minutes using rinse water having a temperature ranging from about 110° F. to 180° F. Most preferably, a scour time of 10 minutes using a rinse water having a temperature of 160° F. is used with a percarbonate type scouring agent. These processing parameters have been found to have maximum efficiency and economy when using about 0.5 to 3 pounds of scouring agent to per 100 pounds of fabric.

Aside from scouring, it is possible to undertake any number of additional post-treatment processes including the addition of softening agents, anti-redeposition agents, deodorizers, or merely subjecting the fabric or garments to a conventional washing process. Consequently, the process of the present invention comprises contacting wet fabric with the pelletized decolorizing agent, and additionally neutralizing the decolorizing agent after processing, as well as optional pre-treatment and post-treatment steps including, desizing, scouring, rinsing, and washing.

Fabric and Dye

Generally, the fabrics which can be subjected to the process of the present invention are dyed fabrics or, alternatively, finished articles made from previously cut and assembled dyed fabric, for example, trousers, jackets, wallets, purses, knapsacks, etc. Fabric or clothing garments processed in accordance with the present invention are generally made of cellulosic materials such as cotton or cotton synthetic fiber blends. The process of the present invention is not limited to a certain weight of fabric and may be applied to denim weight weaves as easily as to fine pin-point cotton weaves.

Generally, the process of the present invention may be used to decolor fabric or garments dyed with any dye or pigment susceptible to decoloration by an active oxidizing or reducing agent. The process may also be used to treat newer fabrics or garments, as well as restoring already used stained or bleached fabric or garments. Cotton fabrics such as denim materials made from cellulosic constituents are usually colored with indigo, a blue dye of the vat dye class.

Indigo is commonly regarded as a vat dye which has a long history of use in the textile world. Chemically, vat dyes are water insoluble organic substances that possess the property of being soluble in alkaline solution. The alkaline solution used to cause the reduction contains a reducing agent such as sodium hydrosulfite, $Na_2S_2O_4$, and caustic soda. An examination of the mechanism of the vat-dyeing process shows that the reduced vat dye ions diffuse into the fiber and are coordinately bonded to the cellulosic molecule by hydrogen bonds and van der Waals forces.

Decolorizing Composition

Generally, the decolorizing composition or agent chemically changes the dye or pigment molecule to a colorless form in the fabric or garment. Accordingly, the pelletized form of the decolorizing agent may contain constituents which effect this purpose including bleaches, reaction regulators, buffers, fillers and binders among others but are used without a pumice stone carrier. Generally, the composition and the concentration of the constituents of the decolorizing agent will depend on the aesthetic appearance to be imparted to the dyed fabric.

Active Decolorant

The principle constituent of the decolorizing agent is an active decolorant. The active decolorant functions to chemically oxidize the dye or pigment used to shade the fabric. Generally, the active decolorant may be selected from any number of oxidizing agents such as halogenated or non-halogenated bleaches which will chemically change the dye or pigment molecule to a colorless molecular form. The selection of an active decolorant is limited by a number of process requirements in the present invention. First, the active decolorant of this invention should not extensively chemically or physically degrade the material. Moreover, the active decolorant should be susceptible to pelletizing processes. Finally, the active decolorant should be compatible with the other constituents used in the decolorizing agent such as buffers, filler's, or binders.

For example, depending on the dye used in the fabric the active decolorant may be any number of oxidizing agents including sodium hypochlorite, lithium hypochlorite, or calcium hypochlorite; isocyanurate complexes such as sodium dichloro-s-triazinetrione dihydrate, potassium dichloro-s-triazinetrione, sodium dichloro-s-triazinetrione, trichloro-s-triazinetrione; halogen hydantoin complexes such as chlorohydantoin, bromochlorohydantoin and complexes thereof; perborate compounds such as sodium perborate; and peroxide complexes such as benzyl peroxide, hydrogen peroxide, sodium percarbonate.

Other compositions which may be used as the active decolorant in this invention include chlorinated trisodium phosphate, potassium peroxy diphosphate, sodium paratoluene sulfonchloramine, potassium peroxymonosulfonate, and peracetic acid.

Preferably the active decolorant used in this invention is an isocyanurate such as trichloro-s-triazinetrione, sodium dichloro-s-triazinetrione, potassium dichloro-s-triazinetrione, or sodium dichloro-s-triazinetrione dihydrate. These isocyanurate complexes afford optimal versatility when pelletizing the decolorizing composition of the present invention.

Other active decolorants which are preferred include calcium hypochlorite, ($Ca(OCl)_2$), due to its chemical stability, ready ability to be pelletized, and relatively low cost. Also preferred are peroxide type oxidizers as they decolorize through a different mechanism than halogen oxidizers. Consequently, yellowing discoloration may be avoided through the use of such peroxide active decolorants.

Although as much as 100% of the active decolorant may be used in the pelletized decolorizing agent at any one time, this amount of active decolorant may be difficult to control in use and provide limited process variability, Generally, a concentration of active decolorant ranging from about 1 wt-% to 85 wt-% and more preferably from about 1 wt-% to 65 wt-% will provide the optimal composition being freely pelletized.

Of course, the concentration of active decolorant in the pellet will always depend on the pattern and extent of decolorizing to be imparted to the fabric. Generally, a lower concentration of active decolorant may result in prolonged processing of the material and ultimately may reduce, or totally eliminate, the potential for imparting a physical decolorized effect to the material. In contrast, a higher concentration of active decolorant may create problems with pelletizing due to chemical incompatibility which could result in a hazardous exothermic reaction. Also, the use of a higher concentration of active decolorant could create safety hazards such as fume inhalation or skin irritation. Finally, as already noted, the use of too high a concentration of active decolorant may result in a reaction which is difficult to control once the decolorizing agent is exposed to the fabric or garment.

Decolorant Regulator

The pelletized decolorizing agent may also contain an active decolorant regulator. This decolorant regulator may have a variety of functions including optimizing or maximizing decolorant effect or, alternatively, regulating or limiting the decolorant effect.

For example, materials such as peroxide bleach activators will increase or maximize the decolorant effect of peroxide oxidizing agent provided within the pelletized decolorizing agent. Constituents which will optimize the decolorant effect may be generally selected from any composition which is known to enhance the reactivity of the active decolorant. Oxidizing activators such as, for example, tetraacetyl ethylenediamine, pentaacetyl glucose and tetraacetyl glycoluril are generally well known and commercially available. These activators may be used in concentration ranging from 0.10 wt-% to 15 wt-%, more preferably 1 wt-% to 7 wt-% and most preferably 1 wt-% to 3 wt-%.

In contrast, the inclusion of a pH buffer system which results in a pH other than that optimally sought for any given decolorant may result in a reduction or limitation of the decoloration effect. Specifically, most active decolorants operate through either oxidative or reductive processes which are highly sensitive to the pH in the surrounding environment. Accordingly, altering the pH of the aqueous environment which the decolorant is introduced regulates the ability of the active decolorant to either oxidize or reduce the dye or pigment present in the fabric.

The buffers also function to minimize damage to the textile. It is thought that more damage to the fabric or material will occur when using halogen based oxidizers such as chlorine bleaches at lower pHs due to the formation of various halide acids. As a result, the pH controlling agents generally maintain the pH of the environment within which the active decolorant works to a pH of about 8 to 13.

Generally any single or combination of pH controlling agents such as buffers which will provide an environment of the proper pH can be used in the processing composition of the present invention. For example, pH controlling agent combinations and individual buffers which have generally been found to be useful in the composition and the process of the present invention include monobasic sodium or potassium phosphate combined with dibasic sodium or potassium phosphate used to provide a pH range of about 5.7 to 8.0; tris acid maleate combined with NaOH used to provide a pH range of about 5.2 to 8.6; tris (hydroxy methyl) amino methane combined with HCl used to provide a pH range of about 7.2 to 9.0; borax combined with NaOH used to provide a pH range of about 9.0 to 10.1; sodium carbonate combined with sodium bicarbonate used to provide a pH range of about 8.5 to 11.0; and boric acid combined with borax used to provide a pH range of about 7.6 to 9.2 among others.

Generally, if pH control is required to insure a certain activity of the active decolorant, the pH controlling agents will preferably be a carbonate/bicarbonate system. These pH control agents are preferred due to their overall stability and compatability with the preferred isocyanurate active decolorants. Also, the carbonate/-bicarbonate system is readily commercially available.

The decolorant regulator may also assist in maintaining the storage stability of the active decolorant by means such as encapsulation. Encapsulates may be used to seal the active decolorant from other active ingredients or environments that would result in neutralization or deactivation of the decolorant. These encapsulates may also be used to regulate the solubility of the pelletized decolorizing agent as well as regulating the rate at which the active decolorant is released from the pelletized decolorizing agent.

Encapsulating agents may also be used to regulate the storage stability of the active decolorant, and, in turn, regulate the solubility of what may be a hydroscopic pellet. Generally, any material which will regulate or limit the solubility or release of the active decolorant may be used. For instance, materials such as hydrophilic waxes, celluloses, and tripolyphosphates are generally preferred as they are easily pelletized, generally inexpensive, and are fairly stable and compatible.

Generally, the amount of active decolorant regulator contained within the decolorizing agent may range from about 0 wt-% to 99 wt-%. Table I provides the useful, preferred and most preferred concentration ranges for the varying decolorant regulators. Here again, the nature and amount of decolorant regulator provided in the decolorizing agent will depend upon the type of decolorant regulator used and the physical appearance to be imparted to the fabric. However, using a lower concentration of active decolorant regulator may result in a lack of control over the intended physical appearance to be imparted to the fabric or garment. For example, the use of a lower concentration of active decolorant regulator such as an encapsulate may result in a rapid dissolution or release of the active decolorant. Moreover, a lower concentration of encapsulate may result in the exposure of the active decolorant to a neutralizing environment or another chemical constituent which may prematurely actively neutralizes the decolorant.

In contrast, the use of a higher concentration of regulator may result in a decolorizing agent having an active decolorant which releases more slowly or is less susceptible to dissolution in the presence of ambient moisture. In the case of a buffer, the use of a higher concentration of pH modifier may be used to limit the oxidative or reductive activity on the part of the active decolorant.

Binders

Additionally, the pelletized decolorizing agent of the present invention may also contain a binder. The primary functions of the binder are to promote a loss of friability in the decolorizing agent composition. In other words, the binder enables the decolorizing agent to be pelletized into hardened masses of varying size.

Creation of a less friable compositional mass through inclusion of any number of binders often affects the aqueous solubility of the composition and, in turn, the release of the active decolorant. For instance, with increased binder the pelletized mass is not as easily crumbled. By maintaining the pelletized decolorizing agent as a relatively larger mass there is less exposure of relative surface area to the aqueous environment. As a result, the pelletized decolorizing agent provides a slower discharge of active decolorant into the ambient environment. Given a constant exposure time between the fabrics and the active decolorant, a slower release of the active decolorant may be used to create a lower contrast between the bleached and unbleached regions of the dyed fabric. In the alternative, a faster release of the active decolorant resulting from a more friable pellet using less binder may provide a higher contrast between the bleached and unbleached regions of the fabric over the same exposure time.

Generally, the binder used in the composition of the present invention may be any liquid, slurried, or semi-solid substance which promotes the formation of a pelletized composition. For example, materials such as alkaline and alkaline earth metal salts of stearates such as calcium stearate; substituted stearate compounds such as sorbitan monostearate, glycerol monostearate, ethylene glycol monostearate and ethylene glycol distearate; sulfonated surfactants such as linear alkaline sulfonates; alkaline and alkaline earth metal silicates such as sodium silicate, and potassium silicate; polyphosphates such as tripotassium polyphosphate, and trisodium polyphosphate; and polycarboxylic acids such as phosphinopolycarboxylic acid may all be used as binders.

The concentration of the binder composition depends upon the physical appearance to be imparted to the fabric. Generally, this concentration can range from about 0 wt-% to 20 wt-%, and more preferably about 1 wt-% to 10 wt-%, and most preferably is about 1 wt-% to 3 wt-%. However, here again, the use of either a higher or lower concentration of binder constituent affects the activity of the pelletized decolorizing agent. Specifically, the use of a higher binder concentration may make the decolorizing agent too tacky or hard. As a result, the decolorizing agent may have reduced aqueous solubility. Moreover, if the decolorizing agent has a higher degree of tack it may not release easily from the mold. In contrast, with a lower binder constituent concentration the pelletized decolorizing agent may be more friable when subjected to the processes of the present invention.

Preferably, the binder used in the decolorizing agent of the present invention is commercially available and relatively inert to the active decolorant. Materials such as phosphinocarboxylic acid commercially available as Belsperse 161 from Ciba-Geigy Corporation are preferred binders. Also preferable are silicates which provide a high degree of binding capacity while remaining relatively inert to the active decolorant.

Fillers

Finally, the decolorizing composition of the present invention may require the addition of a filler constituent. The inclusion of a filler is generally preferred when the active decolorant, buffer, or binder, if used, does not provide the essential solubility, bulk, hardness, or weight to the pelletized decolorizing composition. The fillers used in the composition of this invention are intended to supplement these physical properties within the decolorizing agent without deleteriously hindering the properties of the composition.

Generally, the fillers used in the present invention may include inorganic salts such as, for example, monovalent and divalent sodium or potassium sulfate salts, alkaline and alkaline earth metal chloride salts such as sodium chloride or potassium chloride, alkaline and alkaline earth metal carbonates, alkaline and alkaline earth metal bicarbonates, alkaline and alkaline earth metal acetates, phosphate compositions and complexes, zeolite compositions such as sodium aluminosilicate, and magnesium aluminum silicate.

Preferably, fillers used in the composition of the present invention will be inert to the active decolorant and will provide ready solubility as well as extended storage stability. Compounds such as sodium chloride and sodium sulfate are generally preferred at concentrations which may range generally from about 0 wt-% to 99 wt-% depending upon the needs of the specific pelletized decolorizing agent which has been formulated. More preferably, the filler will be present at a concentration of about 0 wt-% to 50 wt-% and most preferably a concentration of about 10 wt-% to 40 wt-% of the pelletized decolorizing agent composition.

Broadly speaking, if a filler is required, the concentration of filler will vary depending upon the physical characteristics to be imparted to the pelletized decolorizing agent of the present invention.

The use of a lower concentration of filler may result in a pelletized decolorizing agent which does not release from or roll freely among the wet fabric due to a lower weight or a smaller size. Such a pelletized composition may become matted to the fabric and thus provide a more mottled decolorizing action over the entire surface of to be treated. Increasing the concentration of filler may be used to create a harder or heavier pelletized composition which will release more readily from the wet fabric.

Generally, the pelletized decolorizing agent of the present invention may also contain other elements which impart a varying degree of physical or chemical characteristics. Constituents such as optical brighteners, deodorizers and anti-redeposition agents for preventing the redeposition of dye on the fabric may be included in the pelletized composition of the present invention. These items are intended to be merely representative of constituents which may be used in the composition of the present invention and should in no way be construed as limiting upon the disclosed invention.

The physical appearance which is to be imparted to the dyed fabric determines the physical and chemical character of the decolorizing composition. Several process parameters stand out among the others as being highly determinative of the pattern imparted to the fabric. First, the concentration of active decolorant determines the amount and level of contrast between areas of decolorized and colored fabric. Alternatively, using a lower concentration of active decolorant may leave a larger amount of dye chemically unaffected within the fabric.

Detailed in Table IA–IC are three formulations showing useful, preferred, and most preferred constituent concentrations for the decolorizing composition of the present invention.

TABLE IA

| | USEFUL CONCENTRATION RANGE | | |
|---|---|---|---|
| | 1 | 2 | 3 |
| Active Decolorants | | | |
| $Ca(OCl)_2$ | 1–100 wt % | — | — |
| Sodium dichloro-(iso) cyanurate hydrate | — | 1–100 wt % | — |
| Sodium Perborate | — | — | 1–100 wt % |
| Decolorant Regulator | | | |
| buffer | | | |
| Sodium Carbonate/ Sodium Bicarbonate | *pH = 8.5–11.0 | *pH = 8.5–11.0 | *pH = 9.0–12.0 |
| encapsulate | | | |
| Sodium tripolyphosphate | — | 0–40 wt % | — |
| oxidizing activator | | | |
| Tetraacetyl ethylenediamine | — | — | 0.10–15 wt % |
| Binder | | | |
| Phosphinocarboxylic Acid | 0–20 wt % | 0–20 wt % | 0–20 wt % |
| Sodium silicate | 0–20 wt % | 0–20 wt % | 0–20 wt % |
| Filler | | | |
| NaCl | 0–99 wt % | 0–99 wt % | 0–99 wt % |
| Sodium Sulfate | 0–99 wt % | 0–99 wt % | 0–99 wt % |

*pH in resulting environment

TABLE IB

| | PREFERRED CONCENTRATION RANGE | | |
|---|---|---|---|
| | 1 | 2 | 3 |
| Active Decolorants | | | |
| $Ca(OCl)_2$ | 1–85 wt % | — | — |
| Sodium dichloro-(iso) cyanurate hydrate | — | 1–85 wt % | — |
| Sodium Perborate | — | — | 1–85 wt % |
| Decolorant Regulator | | | |
| buffer | | | |
| Sodium Carbonate/ Sodium Bicarbonate | *pH = 9.0–10.9 | *pH = 9.0–10.9 | *pH = 10.0–12.0 |
| encapsulate | | | |
| Sodium tripolyphosphate | — | 0–20 wt % | — |
| oxidizing activator | | | |
| Tetraacetyl ethylenediamine | — | — | 1–7 wt % |
| Binder | | | |
| Phosphinocarboxylic Acid | 1–10 wt % | 1–10 wt % | 1–10 wt % |
| Sodium Silicate | 1–10 wt % | 1–10 wt % | 1–10 wt % |
| Filler | | | |
| NaCl | 0–50 wt % | 0–50 wt % | 0–50 wt % |
| Sodium Sulfate | 0–50 wt % | 0–50 wt % | 0–50 wt % |

*pH in resulting environment

TABLE IC

| | MOST PREFERRED CONCENTRATION RANGE | | |
|---|---|---|---|
| | 1 | 2 | 3 |
| Active Decolorants | | | |
| $Ca(OCl)_2$ | 1–65 wt % | — | — |
| Sodium dichloro-(iso) cyanurate hydrate | — | 1–65 wt % | — |
| Sodium Perborate | — | — | 1–65 wt % |
| Decolorant Regulator | | | |
| buffer | | | |
| Sodium Carbonate/ Sodium Bicarbonate | *pH = 10.2–10.8 | *pH = 10.2–10.8 | *pH = 10.8–11.5 |
| encapsulate | | | |
| Sodium tripolyphosphate | — | 0–10 wt % | — |
| oxidizing activator | | | |
| Tetraacetyl ethylenediamene | — | — | 1–3 wt % |
| Binder | | | |
| Phosphinocarboxylic Acid | 1–3 wt % | 1–3 wt % | 1–3 wt % |
| Sodium Silicate | 1–3 wt % | 1–3 wt % | 1–3 wt % |
| Filler | | | |
| NaCl | 10–40 wt % | 10–40 wt % | 10–40 wt % |
| Sodium Sulfate | 10–40 wt % | 10–40 wt % | 10–40 wt % |

*pH in resulting environment

Pelletizing

The size of the pellets will also have an affects on the resulting pattern which is formed in the dyed material. Specifically, the use of larger irregularly shaped pellets may result in a blotchy, irregular pattern formed on the surface of the fabric. Alternatively, the use of smaller more regularly shaped pellets will result in a more regular pattern, evenly distributed throughout the surface of the fabric. However, if the pellets are too small in size they may adhere to the wet fabric and not roll in the mechanical action of the machine. The lower mass of a smaller pellet can be compensated for through the addition of high density binders, or fillers.

The process for pelletizing the composition of the present invention generally has two steps. First, the constituent powders to be used in the composition of the present invention are introduced into a mixing apparatus such as a ribbon-type blender. The second step in pelletizing the composition of the present invention is the actual step of pelletizing. Generally, the pre-blended powder is placed in a hopper or feeder system and metered into the pelletizer.

The pellet size may vary anywhere from ⅛ inch to over 10 inches in diameter. Combined with the oblong shape, the pelletized decolorizing agents will preferably be between about ½ inch and 10 inches, more preferably between about ½ inch and 5 inches, and most preferably between about ½ inch and 2 inches in overall diameter.

The mass of the pelletized decolorizing agent may vary widely. Generally, the pelletized composition may have an individual unit weight ranging from less than 1 gram to over ½ pound. The amount by which each individual pelletized unit can be reduced in mass is limited here again by the ability of the composition to respond and follow the mechanical action of the machines used to decolorize the dyed fabric. Alternatively, the amount by which the individual pelletized compositional units can be increased in mass is limited by the nature of the pattern to be imparted to the dyed fabric and the mechanical abilities of the machinery used to process the dyed fabric.

Decolorant Neutralizer

The decolorant neutralizer functions to quench or neutralize the active decolorant after the intended level of decolorizing has been imparted onto the fabric or garment. Accordingly, the decolorant neutralizer can be any chemical compound which is capable of stoichiometrically neutralizing the amount of active decolorant present within the ambient system. However, the choice of decolorant neutralizer should be made keeping certain considerations in mind. For example, the decolorant neutralizer should preferably not physically or chemically deteriorate the fabric unless such an effect is desired and controllable. Also, usually the active decolorant is an oxidative or reductive agent which is neutralized with its chemical counterpart. Accordingly, care should be exercised in choosing a decolorant neutralizer which will not be so incompatible with the active decolorant as to promote a spontaneous exothermic reaction. For example, common reducing agents which are used to neutralize active decolorant oxidizers include sodium metabisulfate, sodium thiosulfate, and sodium hydrosulfite.

Generally, the concentration of the decolorant neutralizer, here again, depends upon the appearance to be imparted to the fabric or garment. More specifically, if a definite degree of decolorization is to be imparted to the fabric, the concentration of neutralizer introduced into the system is that which is stoichiometrically necessary to fully chemically inactivate or quench the amount of residual active chemical decolorant present in the system. The use of a lower decolorant neutralizer concentration may result in the retention of residual active decolorant and the continued decolorizing of the fabric or garment. This lower concentration of neutralizer may necessitate extended rinsing of the fabric or garment, or pronounced deterioration or decolorization of the fabric or garment.

Alternatively, the use of a higher concentration of quenching agent or neutralizer may result in residual neutralizer left on the fabric or garment after processing and possibly the deterioration or destruction of the fabric or garment.

Working Examples

Sixteen working examples were prepared using the decolorizing agent composition of the present invention. For each example, the same mixing and pelletizing process was used. The process follows below.

Pelletizing

Sixteen individual 50 pounds batches of decolorizing agent were prepared using the constituent weight percentages provided in Table I. The raw materials were blended in a stainless steel ribbon-type mixer. The alkali source(s) and binder were mixed for 2–5 minutes. At the end of that time, the fillers were blended into the mix. After 1–3 minutes, the active decolorant source was added. The entire dry blend was thoroughly mixed for an additional 3–5 minutes.

The pre-blended powder was placed in a hopper/-weight feeder system and metered into the pelletizer. The pelletizer was supplied from Bepex Corporation (Model 25CS9) and was equipped with a double-roll mold. The roll speeds varied from 8–30 rpm with the average being 12–15 rpm. The operating pressure was 2200 psig. After the produce had been pelletized, it dropped on to a vibrating screen which removes the "rough edges" from the pellets.

The composition of each of the 16 pelletized working examples is indicated in Table I.

TABLE II

| Working Example | Pellet Composition & wt % of Constituents: Sodium Carbonate | Phosphino-carboxylic Acid | Sodium tripoly-phosphate | NaCl | Sodium dichloro-(iso) cyanurate hydrate | Sodium bicarbonate |
|---|---|---|---|---|---|---|
| 1 | 41.0 | 4.0 | 10.0 | 28.0 | 7.0 | 10.0 |
| 2 | 41.0 | 4.0 | 10.0 | 28.0 | 7.0 | 10.0 |
| 3 | 41.0 | 4.0 | 10.0 | 28.0 | 7.0 | 10.0 |
| 4 | 50.0 | 20.0 | 5.0 | 20.0 | 20.0 | 0.0 |
| 5 | 50.0 | 20.0 | 5.0 | 20.0 | 20.0 | 0.0 |
| 6 | 5.4 | 1.4 | 19.8 | 7.8 | 19.8 | 45.8 |
| 7 | 50.0 | 20.0 | 5.0 | 20.0 | 20.0 | 0.0 |
| 8 | 50.0 | 5.0 | 20.0 | 15.0 | 10.0 | 0.0 |
| 9 | 50.0 | 5.0 | 20.0 | 15.0 | 10.0 | 0.0 |
| 10 | 41.0 | 4.0 | 10.0 | 28.0 | 7.0 | 10.0 |
| 11 | 41.0 | 4.0 | 10.0 | 28.0 | 7.0 | 10.0 |
| 12 | 41.0 | 4.0 | 10.0 | 28.0 | 7.0 | 10.0 |
| 13 | 41.0 | 4.0 | 10.0 | 28.0 | 7.0 | 10.0 |
| 14 | 31.0 | 3.0 | 10.0 | 41.5 | 7.0 | 7.5 |
| 15 | 50.0 | 4.0 | 20.0 | 15.0 | 10.0 | 0.0 |
| 16 | 41.0 | 4.0 | 10.0 | 31.0 | 4.0 | 10.0 |

Pretreatment Processing

An amylase enzyme desizing agent at the rate of 32 ounces of active desizing agent per 100 pounds of fabric was used to desize the garments. The desizing process was run for 12 minutes at a water temperature of 160° F. The volume of water used was 25 gallons with a setting of high on a 35 lb. capacity institutional washing machine, Milnor (model) CWM-Mark II Miltrol. After desizing the fabric was rinsed for one minute using 160° F. water temperature with the volume control of the washing machine again set at high. The water was then extracted from the fabric for a period of three minutes with the washing machine set at a low rpm speed. A decolorizing process in accordance with the present invention was then undertaken using Working Example 6–16 using the procedures detailed below.

Decolorizing

The pelletized decolorizing agent was then added to the fabric at a rate of 50 pounds of pelletized decolorizing agent per 100 pounds of fabric. The decolorizing was then undertaken for 30 minutes. After the 30 minute period had ended the active decolorant present in the fabric was quenched using a sodium metabisulfite decolorant neutralizer. Approximately 1.2 pounds of decolorant neutralizer were used per 100 pounds of fabric, and the time of quenching was approximately 10 minutes. Added simultaneously with the decolorant neutralizer was water at a temperature of 120° F. The volume of water used during the quenching process was 25 gallons as indicated by the high setting on the washing machine.

The fabric was then rinsed for two minutes using 25 gallons of 160° F. water. The fabric was then scoured for 10 minutes using 2.0 pounds of sodium percarbonate basic bleach composition. The amount of water used during the scouring process was 25 gallons at a temperature of 160° F. Three individual rinsing steps were then undertaken each two minutes long and using equal volumes of water, the water dropping in temperature 10° from each cycle starting at 140° F. and ending at 120° F.

Post-Treatment

After rinsing was complete, a fabric softening step was undertaken for 5 minutes using a low volume of water at 110° F. The softening agent was a standard quaternary ammonium chloride composition used at 8.0 ounces per 100 pounds of fabric. A sodium percarbonate scouring agent was introduced with the softening agent at the rate of 4.0 ounces per 100 pounds of fabric.

Provided below in Table II is a summary of the process steps undertaken in the 16 working examples.

TABLE III

| Step | Treatment Summary: Time (min.) | Temp (°F.) | Water Level | Treatment Agent | Supply Volume/ cwt |
|---|---|---|---|---|---|
| Desize | 12 | 150 | High | Amylase Enzyme Agent | 32 oz. |
| Rinse | 1 | 150 | High | | |
| Extract | 3 | — | — | | |
| Pelletize | 30 | — | — | Examples 1–17 | 50 lbs. |
| Quench | 10 | 120 | High | Sodium Metabisulfite | 1.2 lbs. |
| Rinse | 2 | 160 | High | | |
| Scour | 10 | 160 | High | Sodium Percarbonate | 2.0 lb. |
| Rinse | 2 | 140 | High | | |
| Rinse | 2 | 130 | High | | |
| Rinse | 2 | 120 | High | | |
| Scour & Soften | 5 | 110 | Low | Sodium Percarbonate | 8.0 oz. |
| | | | | Quaternary Chloride | 4.0 oz. |

Results

As can be seen in Table III, Working Examples 6–16 were rated on the basis of the decoloration effect they had as well as the wt-% active decolorant used and decoloration time.

TABLE IV

| Working Example | Ranking of Decolorant Effect | wt % Active Decolorant | Decoloration Time (min) |
|---|---|---|---|
| 6 | 11.0 | 11.6 | 15.0 |
| 7 | 10.0 | 9.5 | 15.0 |
| 8 | 9.0 | 6.2 | 15.0 |
| 9 | 8.0 | 6.2 | 15.0 |
| 10 | 7.0 | 3.2 | 60.0 |
| 11 | 6.0 | 3.2 | 30.0 |
| 12 | 5.0 | 3.2 | 30.0 |

TABLE IV-continued

| Working Example | Ranking of Decolorant Effect | wt % Active Decolorant | Decoloration Time (min) |
|---|---|---|---|
| 13 | 4.0 | 3.2 | 15.0 |
| 14 | 3.0 | 3.4 | 30.0 |
| 15 | 2.0 | 6.2 | 15.0 |
| 16 | 1.0 | 2.0 | 30.0 |

The decolorizing effect was ranked from highest (a rank of 11) to lowest (a rank of 1). As can be seen, there was generally a direct correlation between the extent of decolorizing effect and the wt-% of active decolorant present in the composition of the present invention. The amount of time in which the decolorant was allowed to work had some secondary affects which allowed increasing the amount of decolorizing imparted even with a lower wt-% of active decolorant.

We claim:

1. A pelletized, stone-free, decolorizing agent for creating decolorized areas in dyed fabric, the decolorizing agent comprising:

(a) an effective decoloring amount of active decolorant; and (b) an effective amount of active decolorant regulator, wherein upon exposure to ambient moisture in the presence of dyed fabric, the pelletized decolorizing agent randomly contacts the fabric through mechanical action and upon contact, the active decolorant chemically decolorizes the dye or pigment present in the fabric.

2. The composition of claim 1 wherein the active decolorant is selected from a group consisting of calcium hypochlorite, and lithium hypochlorite.

3. The composition of claim 1 wherein the active decolorant is selected from the group consisting of sodium dichloro-s-triazinetrione dihydrate, potassium dichloro-s-triazinetrione, sodium dichloro-s-triazinetrione, and trichloro-s-triazinetrione.

4. The composition of claim 1 wherein the active decolorant regulator comprises at least one buffer agent, the buffering agents being selected from the group consisting of sodium hydroxide, monobasic sodium phosphate, monobasic potassium phosphate, dibasic sodium phosphate, dibasic potassium phosphate, alkaline carbonates, alkaline earth metal carbonates, alkaline bicarbonates, alkaline earth metal bicarbonates, hydrochloric acid, borax, boric acid, tris acid maleate, and tris(hydroxy methyl) amino methane.

5. The composition of claim 1 wherein the active decolorant regulator comprises an encapsulating agent coated over the exterior surface of the pelletized decolorizing agent, the encapsulating agent being selected from the group consisting of hydrophilic waxes, hydrophilic celluloces, and alkaline and alkaline earth metal tripolyphosphates.

6. The composition of claim 1 wherein the active decolorant regulator comprises an oxidizing activator, the oxidizing activator being selected from the group consisting of tetraacetyl ethylenediamine, pentaacetyl glucose, and tetraacetyl glycoluril.

7. The composition of claim 1 additionally comprising about 0 wt-% to 20 wt-% of a binder constituent.

8. The composition of claim 7 wherein the binder constituent is selected from the group consisting of phosphino carboxylic acid, alkaline silicates, alkaline earth metal silicates, alkaline polyphosphates, alkaline earth metal polyphosphates, alkyl polyol monostearates, alkyl polyol distearates, alkaline metal salts of stearates, and alkaline earth metal stearate salts.

9. The pelletized stone-free decolorizing agent of claim 1 additionally comprising a filler constituent present in a concentration of about 0 wt-% to 99 wt-% of the pelletized stone-free decolorizing agent.

10. The composition of claim 9 wherein the filler is selected from the group consisting of alkaline and alkaline earth metal chloride salts, sodium sulfate, disodium sulfate, potassium sulfate, dipotassium sulfate, alkaline metal carbonates, alkaline earth metal carbonates, alkaline metal bicarbonates, alkaline earth metal bicarbonates, alkaline metal acetates, and alkaline earth metal acetates.

11. A pelletized stone-free decolorizing agent for creating decolorized areas in dyed fabric, the decolorizing agent comprising:

(a) about 1 wt-% to 99 wt-% of active decolorant;

(b) about 1 wt-% to 99 wt-% of active decolorant regulator;

(c) about 0 wt-% to 20 wt-% of binder constituent; and (d) about 0 wt-% to 99 wt-% of a filler constituent, wherein upon exposure to ambient moisture in the presence of dyed fabric, the pelletized decolorizing agent randomly contacts the fabric through mechanical action and upon contact, the active decolorant chemically decolorizes the dye or pigment present in the fabric.

12. The composition of claim 11 wherein the active decolorant is selected from the group consisting of calcium hypochlorite and lithium hypochlorite.

13. The composition of claim 11 wherein the active decolorant is selected from the group consisting of sodium dihloro-s-triazinetrione dihydrate, potassium dichloro-s-triazinetrione, and sodium dichloro-s-triazinetrione.

14. The composition of claim 11 wherein the active decolorant regulator comprises an encapsulating agent coated over the exterior surface of the pelletized decolorizing agent, the encapsulating agent being selected from the group consisting of hydrophilic waxes, hydrophilic cellulosis, and alkaline and alkaline earth metal tripolyphosphates.

15. The composition of claim 11 wherein the active decolorant regulator comprises an oxidizing activator, the oxidizing activator being selected from the group consisting of tetraacetyl ethylenediamine, pentaacetyl glucose, and tetraacetyl glycoluril.

16. The composition of claim 11 wherein the binder constituent is selected from the group consisting of phosphino carboxylic acid, alkaline silicates, alkaline earth metal silicates, alkaline polyphosphates, alkaline earth metal polyphosphates, alkyl polyol monostearates, alkyl polyol distearates, alkaline metal salts of stearates, and alkaline earth metal stearate salts.

17. The composition of claim 11 wherein the filler is selected from the group consisting of alkaline and alkaline earth metal chloride salts, sodium sulfate, disodium sulfate, potassium sulfate, dipotassium sulfate, alkaline metal carbonates, alkaline earth metal carbonates, alkaline metal bicarbonates, alkaline earth metal bicarbonates, alkaline metal acetates, and alkaline earth metal acetates.

* * * * *

UNITED STATES PATENT AND TRADEMARK OFFICE

CERTIFICATE OF CORRECTION

PATENT NO. : 5,370,708

DATED : December 6, 1994

INVENTOR(S) : Lynne A. Olson et al.

It is certified that error appears in the above-identified patent and that said Letters Patent is hereby corrected as shown below:

On column 3, line 40, please insert --decolorant-- after the word "active"

On column 4, line 32, please delete "the" after the word "completed" (first occurrence).

On column 9, line 47, please delete "neutralizes" and substitute therefore --neutralize--

On column 11, line 54, please delete "of" after the word "surface"

On column 13, line 30, please delete "affects" and substitute therefore --effect--

On column 14, line 54, please delete "pounds" and substitute therefore --pound--

On column 15, line 5, please delete "I" and substitute therefore --II--

On column 16, line 30, please delete "II" and substitute therefore --III--

UNITED STATES PATENT AND TRADEMARK OFFICE

CERTIFICATE OF CORRECTION

PATENT NO. : 5,370,708

DATED : December 6, 1994

INVENTOR(S) : Lynne A. Olson et al.

It is certified that error appears in the above-identified patent and that said Letters Patent is hereby corrected as shown below:

On column 16, line 51, please insert --Ammonium-- after the word "Quaternary"

On column 16, line 56, please delete "III" and substitute therefore --IV--

On column 17, line 54 (claim 5), please delete "celluloces" and substitute therefore --celluloses--

On column 18, line 44 (claim 14), please delete "cellulosis" and substitute therefore --celluloses--

On column 18, line 36 (claim 13), please delete "dihloro" and substitute therefore --dichloro--

Signed and Sealed this

Twenty-eight Day of March, 1995

*Attest:*

Bruce Lehman

BRUCE LEHMAN

*Attesting Officer*

*Commissioner of Patents and Trademarks*